US009404376B2

(12) United States Patent
Potter et al.

(10) Patent No.: US 9,404,376 B2
(45) Date of Patent: Aug. 2, 2016

(54) SEALING COMPONENT FOR REDUCING SECONDARY AIRFLOW IN A TURBINE SYSTEM

(71) Applicant: General Electric Company, Schenectady, NY (US)

(72) Inventors: Brian Denver Potter, Greer, SC (US); Gary Charles Liotta, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 464 days.

(21) Appl. No.: 14/064,461

(22) Filed: Oct. 28, 2013

(65) Prior Publication Data

US 2015/0114001 A1 Apr. 30, 2015

(51) Int. Cl.
*F01D 11/00* (2006.01)

(52) U.S. Cl.
CPC ..... *F01D 11/006* (2013.01); *F01D 11/001* (2013.01)

(58) Field of Classification Search
CPC ..... F01D 11/001; F01D 11/006
See application file for complete search history.

(56) References Cited

U.S. PATENT DOCUMENTS 2,656,147 A * 10/1953 Brownhill ..... F01D 5/084 416/193 A
3,295,825 A * 1/1967 Hall, Jr. ..... F01D 5/06 415/173.7
3,733,146 A 5/1973 Smith et al.
4,030,265 A 6/1977 Allgood
4,088,422 A 5/1978 Martin
4,645,424 A * 2/1987 Peters ..... F01D 5/026 415/173.7
4,659,289 A * 4/1987 Kalogeros ..... F01D 5/3015 415/173.7
4,869,640 A * 9/1989 Schwarz ..... F01D 11/001 415/115
4,884,950 A 12/1989 Brodell et al.
5,217,348 A * 6/1993 Rup, Jr. ..... F01D 25/12 415/115
5,338,154 A * 8/1994 Meade ..... F01D 11/001 403/371
5,352,087 A * 10/1994 Antonellis ..... F01D 11/025 415/115
5,358,374 A * 10/1994 Correia ..... F01D 5/081 415/115
5,749,701 A 5/1998 Clarke et al.
5,833,244 A 11/1998 Salt et al.
6,464,453 B2 * 10/2002 Toborg ..... F01D 5/081 415/115
8,221,062 B2 7/2012 Liotta et al.
8,348,603 B2 1/2013 Garcia-Crespo et al.

FOREIGN PATENT DOCUMENTS

EP 2218879 A2 8/2010

* cited by examiner

*Primary Examiner* — Igor Kershteyn
(74) *Attorney, Agent, or Firm* — Ernest G. Cusick; Frank A. Landgraff

(57) ABSTRACT

A sealing component for reducing secondary airflow in a turbine system includes a first end segment configured to be disposed between, and retained in a radial direction by, a first land on a first rotor disk and a first turbine bucket platform operatively coupled to the first rotor disk. Also included is a second end segment configured to be disposed between, and retained in a radial direction by, a second land on a second rotor disk and a second turbine bucket platform operatively coupled to the second rotor disk. Further included is a main body portion extending axially from the first end segment to the second end segment.

20 Claims, 3 Drawing Sheets

SEALING COMPONENT FOR REDUCING SECONDARY AIRFLOW IN A TURBINE SYSTEM

BACKGROUND OF THE INVENTION

The subject matter disclosed herein relates to turbine systems and, more particularly, to a sealing component for reducing secondary airflow in a turbine system.

Turbine components are typically directly exposed to high temperature gases, and therefore require cooling to meet their useful life. For example, some of the compressor discharge air is diverted from the combustion process for cooling rotor components of the turbine. Turbine buckets, blades and vanes typically include internal cooling channels therein which receive compressor discharge air or other cooling gases for cooling thereof during operation. In addition, turbine rotor disks which support the buckets are subject to significant thermal loads and thus also need to be cooled to increase their lifetimes.

The main flow path of the turbine is designed to confine combustion gases as they flow through the turbine. Turbine rotor structural components must be provided with cooling air independent of the main gas flow to prevent ingestion of the hot combustion gases therein during operation, and must be shielded from direct exposure to the hot flow path gas. Such confinement is accomplished by rotary seals positioned between the rotating turbine buckets to prevent ingestion or back flow of the hot air or gases into interior portions of the turbine rotor structure. Such rotary seals are insufficient to completely protect the interior components, such as the rotor structure, rotor and rotor disks, requiring the additional use of purge flows of cooling air into and through the rotor cavity. Such additional measures to protect the interior components increase the cost and complexity and hinder the performance of gas turbines.

BRIEF DESCRIPTION OF THE INVENTION

According to one aspect of the invention, a sealing component for reducing secondary airflow in a turbine system includes a first end segment configured to be disposed between, and retained in a radial direction by, a first land on a first rotor disk and a first turbine bucket platform operatively coupled to the first rotor disk. Also included is a second end segment configured to be disposed between, and retained in a radial direction by, a second land on a second rotor disk and a second turbine bucket platform operatively coupled to the second rotor disk. Further included is a main body portion extending axially from the first end segment to the second end segment.

According to another aspect of the invention, a gas turbine engine includes a compressor section and a combustor section. Also included is a turbine section having a first turbine bucket attached to a first rotor disk, a second turbine bucket attached to a second rotor disk, and a stationary turbine nozzle located axially between the first rotor disk and the second rotor disk. Further included is a sealing component extending axially between the first rotor disk and the second rotor disk. The sealing component includes a first end segment disposed between, and in contact with, a first axially extending land of the first rotor disk and a first platform of the first turbine bucket. The sealing component also includes a second end segment disposed between, and in contact with, a second axially extending land of the second rotor disk and a second platform of the second turbine bucket. The sealing component further includes a main body portion extending between the first end segment and the second end segment.

According to yet another aspect of the invention, a method of sealing a flow path of a gas turbine engine is provided. The method includes positioning a first end segment of a sealing component on a first axially extending land of a first rotor disk. The method also includes positioning a second end segment of the sealing component on a second axially extending land of a second rotor disk. The method further includes positioning a first platform of a first turbine bucket on the first end segment to radially retain the first end segment between the first axially extending land and the first platform. The method yet further includes positioning a second platform of a second turbine bucket on the second end segment to radially retain the second end segment between the second axially extending land and the second platform.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
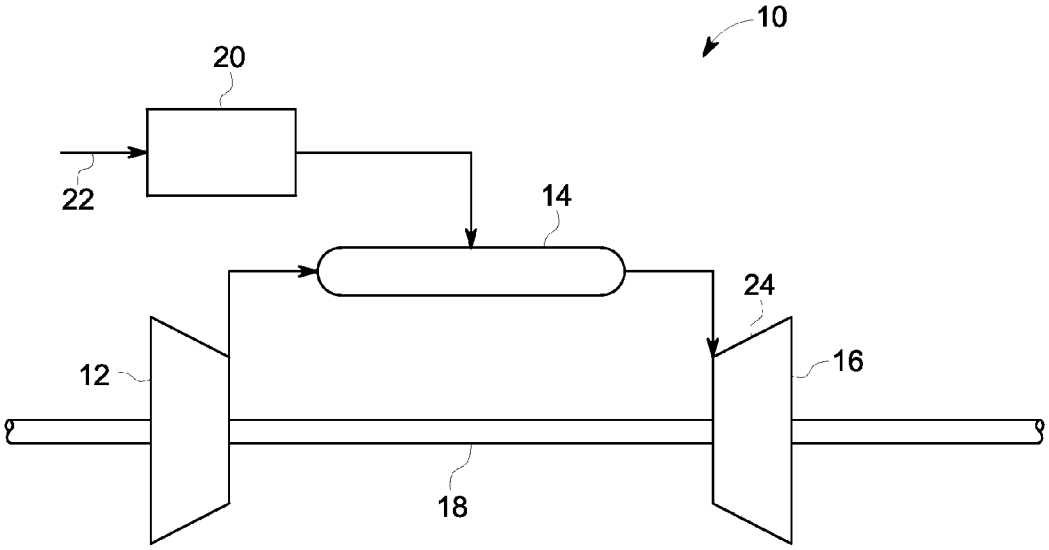
FIG. 1 is a schematic illustration of a gas turbine engine.

Referring to FIG. 1, a turbine system, such as a gas turbine engine, for example, is schematically illustrated and generally referenced with numeral 10. The gas turbine engine 10 includes a compressor section 12, a combustor section 14, a turbine section 16, a rotor 18 and a fuel nozzle 20. It is to be appreciated that one embodiment of the gas turbine engine 10 may include a plurality of compressors 12, combustors 14, turbines 16, rotors 18 and fuel nozzles 20. The compressor section 12 and the turbine section 16 are coupled by the rotor 18.

The combustor section 14 uses a combustible liquid and/or gas fuel, such as natural gas or a hydrogen rich synthetic gas, to run the gas turbine engine 10. For example, fuel nozzles 20 are in fluid communication with an air supply and a fuel supply 22. The fuel nozzles 20 create an air-fuel mixture, and discharge the air-fuel mixture into the combustor section 14, thereby causing a combustion that creates a hot pressurized exhaust gas. The combustor section 14 directs the hot pressurized gas through a transition piece into a turbine nozzle (or "stage one nozzle"), and other stages of buckets and nozzles causing rotation of turbine blades within an outer casing 24 of the turbine section 16.

Figure 2:
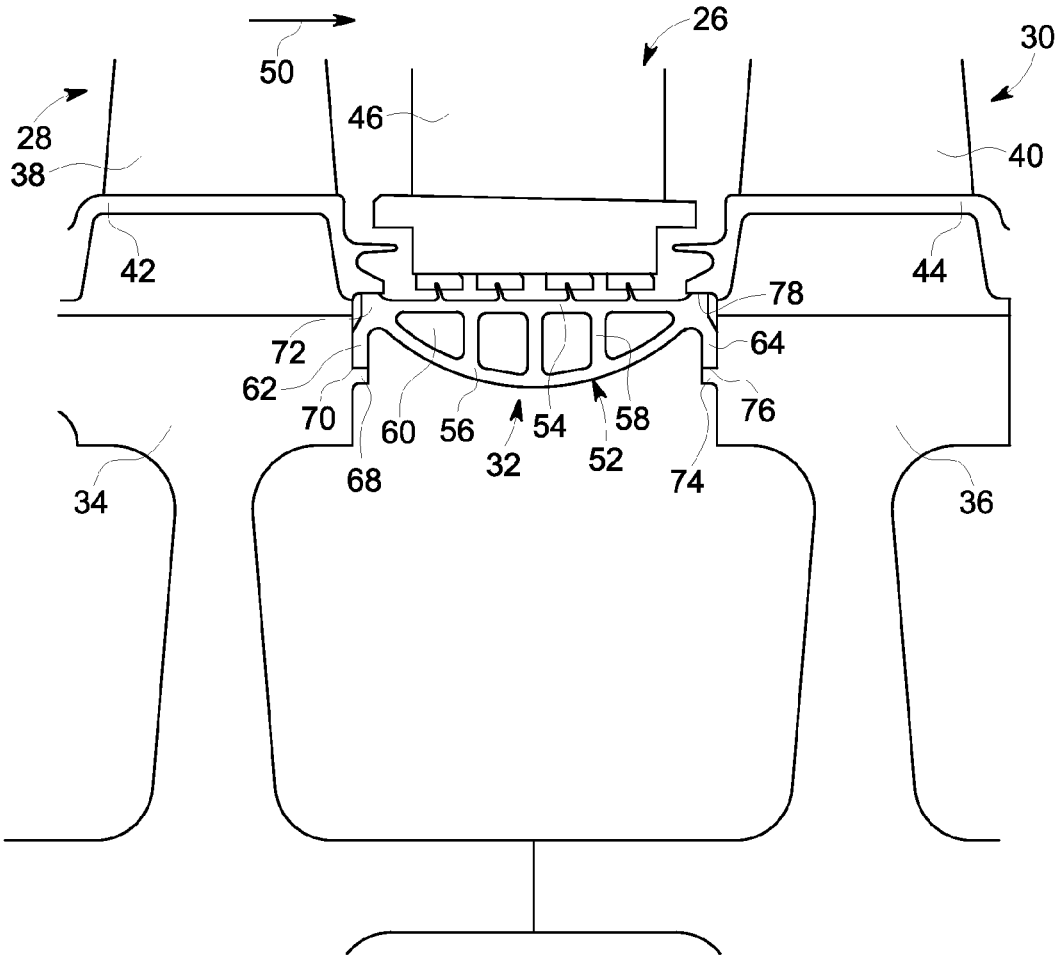
FIG. 2 is a side view illustration of a portion of a gas turbine engine including a sealing component.

Referring to FIG. 2, a portion of the turbine section 16 is illustrated in greater detail. The turbine section 16 includes alternating inter-stage nozzle stages 26 and turbine stages, such as a first turbine stage 28 and a second turbine stage 30. A sealing component 32 is disposed between the first turbine stage 28 and the second turbine stage 30. Although the embodiments described herein are described with reference to the turbine section 16 of the gas turbine engine 10, the embodiments may also be utilized in conjunction with the compressor section 12 of the gas turbine engine 10.

The first turbine stage 28 and the second turbine stage 30 each include respective rotor disks attached to a rotor shaft (not shown) that causes the rotor disks to rotate about a central axis. Specifically, the first turbine stage 28 includes a first rotor disk 34 and the second turbine stage includes a second rotor disk 36. A plurality of blades or buckets is removably attached to an outer periphery of each rotor disk. For illustration purposes, a single turbine bucket for each stage is illustrated. In particular, a first turbine bucket 38 is attached to the first rotor disk 34 and a second turbine bucket 40 is attached to the second rotor disk 36. The buckets are attached by any suitable mechanism, such as an axially extending dovetail connection. In one embodiment, the buckets each include a bucket platform configured to attach to the corresponding rotor disk. In the illustrated embodiment, the first turbine bucket 38 includes a first platform 42 and the second turbine bucket 40 includes a second platform 44. As used herein, an "axial" direction is a direction parallel to the central axis, and a "radial" direction is a direction extending from the central axis and perpendicular to the central axis. An "outer" location refers to a location in the radial direction that is farther away from the central axis than an "inner" location.

The nozzle stage 26 includes a plurality of nozzle vanes 46 that are each operatively connected to the outer casing 24 of the turbine section 16, such as a turbine shell or an outer support ring attached thereto, and extend radially toward the central axis. In one embodiment, each of the plurality of nozzle vanes 46 are attached to an inner support ring having a diameter less than a diameter of the outer support ring.

A sealing component 32 is included to reduce heated gas or air from leaking into interior portions of the turbine section 16 and away from a flow path 50 defined by the buckets and the nozzle stage. The sealing component 32 is disposed in a fixed position relative to the rotating rotor disks, and therefore rotates along with the rotor disks. As described in detail below, the sealing component 32 causes a sealing connection between the sealing component 32 and the buckets, such as the first turbine bucket 38 and the second turbine bucket 40.

The sealing component 32 is typically a single, uniform structure shaped similar to a tied-arch bridge and configured to handle centrifugal forces associated with operation of the gas turbine engine 10. Specifically, the sealing component 32 includes a main body portion 52 formed of a relatively planar portion 54, an arched portion 56, and a plurality of tie segments 58 connecting the relatively planar portion 54 and the arched portion 56. The plurality of tie segments 58 forms at least one, but typically a plurality of hollow portions 60. The plurality of hollow portions 60 reduces the overall weight and material cost of the sealing component 32.

A first end segment 62 and a second end segment 64 are disposed at opposite axial ends of the sealing component 32, such that the main body portion 52 extends axially from the first end segment 62 and the second end segment 64. The first end segment 62 is disposed between the first turbine bucket 38 and a first land 68 of the first rotor disk 34. As shown, the first land 68 extends axially in an aft direction. In particular, the first end segment 62 is "sandwiched" and thereby retained in a radial direction by portions of the first turbine bucket 38 and the first land 68. In the illustrated embodiment, the first end segment 62 includes a first end 70 in contact with a radially outer face of the first land 34 and a second end 72 in contact with a radially inner face of the first platform 42. Similarly, the second end segment 64 is "sandwiched" and thereby retained in a radial direction by portions of the second turbine bucket 40 and a second land 74 of the second rotor disk 36. The second land 74 extends axially in a forward direction. The second end segment 64 includes a third end 76 in contact with a radially outer face of the second land 74 and a fourth end 78 in contact with a radially inner face of the second platform 44.

The sealing component 32 extends between adjacent turbine bucket stages, such as between the first turbine stage 28 and the second turbine stage 30, as illustrated, to seal a region extending between the adjacent stages. The fitted relationship between the stages retains the sealing component 32 in an axial direction. In one embodiment, additional axial retention is provided with a hook arrangement. In such an embodiment, a portion of the first end segment 62 and/or the second end segment 64 is engaged with a receiving feature of the first land 68, the second land 74, the first platform 42 and/or the second platform 44.

The sealing component 32 is cast or otherwise made from high temperature materials capable of withstanding elevated temperatures such as 1500° F. or greater. Examples of such materials include nickel based superalloys such as those alloys used for flow path components. Additionally or alternatively, the sealing component 32 may be actively cooled. To facilitate replacement of the sealing component 32, typically the sealing component 32 is formed as a circumferential segment extending around a portion of an axis of rotation of the gas turbine engine 10.

Figure 3:
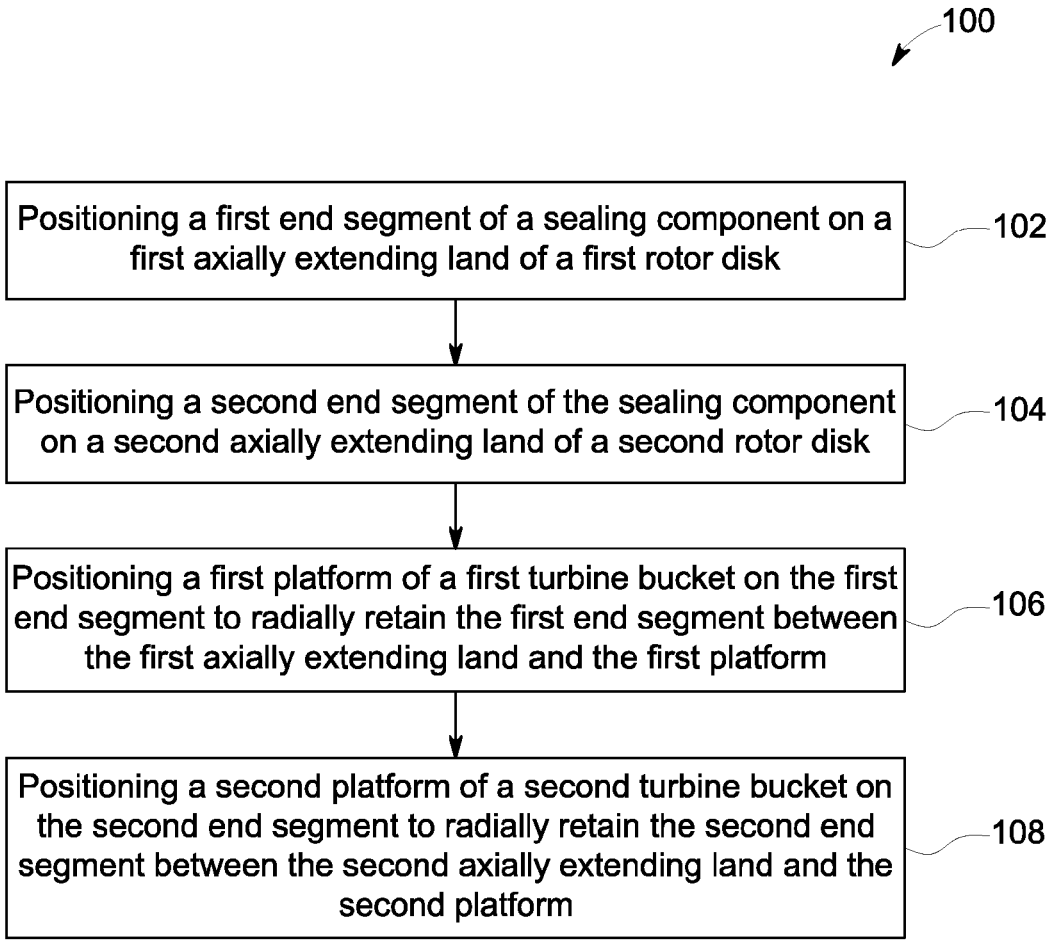
FIG. 3 is a flow diagram illustrating a method of sealing a flow path of the gas turbine engine.

As illustrated in the flow diagram of FIG. 3, and with reference to FIGS. 1 and 2, a method of sealing a flow path of a gas turbine engine 100 is also provided. The gas turbine engine 10 and the sealing component 32 have been previously described and specific structural components need not be described in further detail. The method of sealing a flow path of a gas turbine engine 100 includes positioning a first end segment of a sealing component on a first axially extending land of a first rotor disk 102. The method also includes positioning a second end segment of the sealing component on a second axially extending land of a second rotor disk 104. A first platform of a first turbine bucket is positioned on the first end segment to radially retain the first end segment between the first axially extending land and the first platform 106. A second platform of a second turbine bucket is positioned on the second end segment to radially retain the second end segment between the second axially extending land and the second platform 108.

The devices, systems and methods described herein provide numerous advantages over alternative systems. For example, the devices, systems and methods provide the technical effect of increasing efficiency and performance of the turbine by reducing the number of components and by reducing or eliminating or reducing the need for cooling gas flows. For example, the sealing component 32 alleviates the need for spacer wheels used often employed to support other sealing components and assemblies. Furthermore, the prevention of air flow leakage into interior cavities of the turbine reduces the level of cooling flow required, thus improving turbine efficiency and reducing cost.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A sealing component for reducing secondary airflow in a turbine system comprising:

a first end segment configured to be disposed between, and retained in a radial direction by, a first land on a first rotor disk and a first turbine bucket platform operatively coupled to the first rotor disk;

a second end segment configured to be disposed between, and retained in a radial direction by, a second land on a second rotor disk and a second turbine bucket platform operatively coupled to the second rotor disk.; and a main body portion extending axially from the first end segment to the second end segment.

2. The sealing component of claim 1, wherein the main body portion comprises a relatively planar portion, an arched portion and a plurality of tie segments connecting the relatively planar portion and the arched portion.

3. The sealing component of claim 2, wherein the plurality of tie segments define at least one hollow portion.

4. The sealing component of claim 1, wherein the sealing component comprises a high temperature material configured to withstand flow path gas temperatures.

5. The sealing component of claim 1, wherein the sealing component is a circumferential segment extending around a portion of a turbine axis.

6. The sealing component of claim 1, wherein the first end segment comprises a first end configured to abut the first land and a second end configured to abut the first turbine bucket platform, wherein the second end segment comprises a third end configured to abut the second land and a fourth end configured to abut the second turbine bucket platform.

7. The sealing component of claim 1, wherein the sealing component is configured to seal a region extending between adjacent stages of turbine buckets.

8. The sealing component of claim 1, wherein at least one of the first land and the second land comprises a receiving feature configured to receive a hook extending from the sealing component.

9. The sealing component of claim 1, wherein the sealing component is an actively cooled structure.

10. A gas turbine engine comprising:

a compressor section;

a combustor section;

a turbine section having a first turbine bucket attached to a first rotor disk, a second turbine bucket attached to a second rotor disk, and a stationary turbine nozzle located axially between the first rotor disk and the second rotor disk; and a sealing component extending axially between the first rotor disk and the second rotor disk, the sealing component comprising:

a first end segment disposed between, and in contact with, a first axially extending land of the first rotor disk and a first platform of the first turbine bucket;

a second end segment disposed between, and in contact with, a second axially extending land of the second rotor disk and a second platform of the second turbine bucket; and a main body portion extending between the first end segment and the second end segment.

11. The gas turbine engine of claim 10, wherein the main body portion comprises a relatively planar portion, an arched portion and a plurality of tie segments connecting the relatively planar portion and the arched portion.

12. The gas turbine engine of claim 11, wherein the plurality of tie segments define at least one hollow portion.

13. The gas turbine engine of claim 10, wherein the sealing component comprises a high temperature material configured to withstand flow path gas temperatures.

14. The gas turbine engine of claim 10, wherein the sealing component is a circumferential segment extending around a portion of a turbine axis.

15. The gas turbine engine of claim 10, wherein the first end segment comprises a first end configured to abut the first axially extending land and a second end configured to abut the first platform of the first turbine bucket, wherein the second end segment comprises a third end configured to abut the second axially extending land and a fourth end configured to abut the second platform of the second turbine bucket.

16. The gas turbine engine of claim 10, wherein the sealing component is configured to seal a region extending between adjacent stages of turbine buckets.

17. The gas turbine engine of claim 10, wherein at least one of the first axially extending land and the second axially extending land comprises a receiving feature configured to receive a hook extending from the sealing component.

18. The gas turbine engine of claim 10, further comprising:

an aft face of the first rotor disk in contact with the first end segment;

a forward face of the second rotor disk in contact with the second end segment, wherein the aft face and the forward face axially retain the sealing component.

19. The gas turbine engine of claim 10, wherein the sealing component is an actively cooled structure.

20. A method of sealing a flow path of a gas turbine engine comprising:

positioning a first end segment of a sealing component on a first axially extending land of a first rotor disk;

positioning a second end segment of the sealing component on a second axially extending land of a second rotor disk;

positioning a first platform of a first turbine bucket on the first end segment to radially retain the first end segment between the first axially extending land and the first platform; and positioning a second platform of a second turbine bucket on the second end segment to radially retain the second end segment between the second axially extending land and the second platform.

* * * * *